US007357112B2

(12) United States Patent
Patten

(10) Patent No.: US 7,357,112 B2
(45) Date of Patent: Apr. 15, 2008

(54) METHOD FOR REORIENTING A HORIZONTAL SHAFT DIESEL ENGINE TO VERTICAL OPERATION

(75) Inventor: J. P. Patten, Orlando, FL (US)

(73) Assignee: Hugr Systems, Inc., Pompano Beach, FL (US)

( * ) Notice: Subject to any disclaimer, the term of this patent is extended or adjusted under 35 U.S.C. 154(b) by 0 days.

(21) Appl. No.: 11/457,031

(22) Filed: Jul. 12, 2006

(65) Prior Publication Data

US 2007/0012280 A1 Jan. 18, 2007

Related U.S. Application Data

(60) Provisional application No. 60/698,557, filed on Jul. 12, 2005.

(51) Int. Cl.
*F02B 75/00* (2006.01)
*F02B 61/04* (2006.01)

(52) U.S. Cl. ..... 123/196 W

(58) Field of Classification Search ..... 123/196 W, 123/196 R; 184/6.5, 6.26, 11.1
See application file for complete search history.

(56) References Cited

U.S. PATENT DOCUMENTS 3,824,973 A * 7/1974 Harhaus ..... 123/90.34
5,065,720 A 11/1991 Nishiyama et al.
5,176,116 A 1/1993 Imagawa et al.
5,606,944 A 3/1997 Kurihara
6,405,690 B1 6/2002 Eder

FOREIGN PATENT DOCUMENTS

WO WO 2005026504 A1 * 3/2005

* cited by examiner

*Primary Examiner*—Stephen K. Cronin
*Assistant Examiner*—Hyder Ali
(74) *Attorney, Agent, or Firm*—James H. Beusse; Beusse Wolter Sanks Mora & Maire, P.A.

(57) ABSTRACT

A method for modifying a small diesel engine from a horizontal drive or crankshaft orientation into a vertical crankshaft orientation incorporates blocking of existing oil flow paths to rocker arms of the engine and replacement with pressurized low volume oil flow. In one form, tubing is added to direct oil from an oil pump onto the rocker arm mechanism. Additional tubing is then added to provide for oil drainage from the valve area to the oil reservoir in the engine crankcase.

5 Claims, 3 Drawing Sheets

METHOD FOR REORIENTING A HORIZONTAL SHAFT DIESEL ENGINE TO VERTICAL OPERATION

SPECIFIC DATA RELATED TO THE INVENTION

This application claims the benefit of U.S. provisional application No. 60/698,557 filed Jul. 12, 2005.

BACKGROUND OF THE INVENTION

The present invention relates to air-cooled internal combustion engines and, more particularly, to a single cylinder diesel engine that is converted from a conventional horizontal shaft machine into a vertical shaft machine.

Single cylinder diesel engines are currently available in which the crankshaft of the engine is oriented in a horizontal configuration. The piston in such engines reciprocates vertically in a plane generally normal to the axis of the shaft. Such engines have intake and exhaust valves that are located at a top of the piston cylinder with the conventional rocker arm assembly or valve mechanism located above the valves for opening and closing the valves in a vertical direction. The positioning of the valves at the top of the single cylinder is such that if the engine is laid on its side so that the shaft can be oriented in a vertical position, the exhaust valve is situated below the intake valve and is susceptible to inhaling oils spilling from the crankcase or lower part of the engine into the head or top of the engine where the valve mechanism is located. Accordingly, the challenge faced by rotating the engine so as to be operable with the shaft vertically oriented is to control the amount of oil provided to the intake and exhaust valve control mechanism. As is well known, too much oil will cause the engine to badly smoke and may result in burning or damage to the intake or exhaust valves.

SUMMARY OF THE INVENTION

The inventor has discovered that the small single cylinder diesel engine can be operated on its side by controlling the amount of oil delivered to the head of the engine during operation. Additionally, the oil must be removed to prevent accumulation and feeding into the exhaust or intake valves. Too little oil can result in overheating of the engine, valve sticking and engine failure. Too much oil would create a puddle that can overcome the exhaust valve entering the combustion chamber causing the engine to run and perform poorly and create an increase in emissions.

In the present invention, oil is pumped from the bottom of the crankcase of the engine into the oil pump and directly to the crankshaft. There is a journal in the center of the crankshaft that carries the oil from the rear of the engine to the connecting rod and forward to the front main seal. This forced oil completely lubricates the lower portion of the engine. The head or top of the engine is lubricated via oil splashed upward from the bottom of the crankcase as a result of the spinning camshaft balancer and gears associated with the camshaft. Part of this oil transfer via the splash method is caused by the alternate pressurization and depressurization of the lower portion of the engine, i.e., the area of the crankcase where the shaft is located, by the movement of the piston. This oil is forced upward through a passageway or galley extending from the lower portion of the crankcase to the upper portion where the valve mechanism or rocker arms are located. The rocker arms are driven by push rods that also pass through the passageway and are lubricated by the splashed oil that is pushed upward due to the pressurization of the lower portion of the crankcase. The area of the galley or passageway is fairly large and provides for adequate lubrication of the rocker arms or valve mechanism by the splashed oil. This oil also lubricates the intake and exhaust valve assemblies. The oil condenses and falls to the bottom of the head and is drained back through the galley or passageway towards the lower part of the crankcase. In most of these engines, there is provided a protected vent that allows the draining oil to drain back into the oil reservoir at the bottom and has a splash shield to prevent the airborne oil from draining into the vent before being forced upward into the rocker arm mechanism.

When the engine is rotated so that the driveshaft is in a vertical position, the galley is laying in a horizontal configuration and oil can flow freely through the galley into the head area of the engine. Because of this undesirable accumulation of oil at the head, the engine will smoke badly due to oil entering the exhaust valve area. In order to control the flow of oil, the inventor has found that closing the passageway or galley at the crankcase lower end will block the flow of oil into the head. In addition, the return vent located near the bottom of the passageway is also blocked to prevent oil from passing through the vent and into the galley. The blocking can be done with either a specially designed plate that fits the passageway or by filling the passageway with other material such as an epoxy based filler. The conventional oil pick up is also blocked using either a plug or an epoxy filler.

In order to deliver oil to the head, applicant has found that small holes can be provided through the device blocking the passageway with the size of the holes depending on the size of the engine and oil demand in the head of the engine. This method will raise the level of oil in the galley and reduce the amount of airborne oil to only the necessary amount needed for proper operation of the rocker arm mechanism. Alternately, a bypass line may be provided from the oil pump to the head of the engine. The oil may be obtained from a channel between the oil pump and the crankshaft bearing by simply drilling out a hole to accommodate a conventional fitting. A tube can then be connected from that fitting to the blocked passageway so that the oil is directed towards the head.

DETAILED DESCRIPTION OF THE INVENTION

Figure 1:
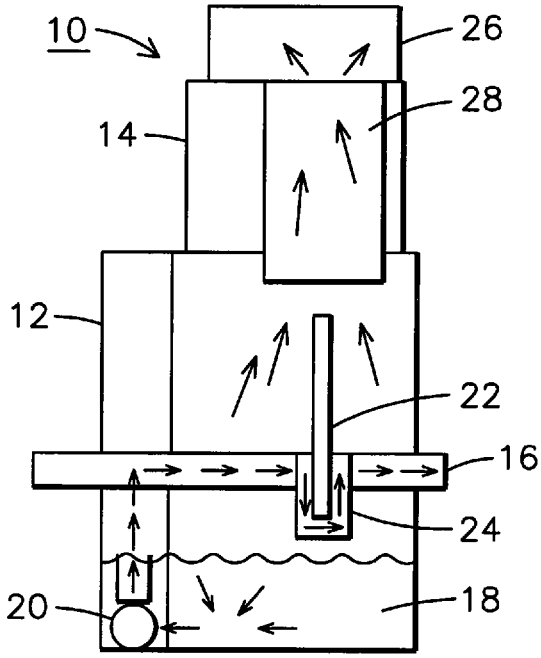
FIG. 1 is a simplified block diagram representation of a horizontal shaft engine.

Referring now to FIG. 1, there is shown a simplified block diagram representation of a single cylinder diesel engine having a horizontal drive shaft or crankshaft. The engine 10 includes a crankcase portion 12 and a head portion 14. A crankshaft 16 extends through the crankcase 12 and provides connection for power output from the engine. Oil 18 is normally found in the lower portion of the crankcase as is an oil pump 20. The oil pump 20 pressurizes oil and forces it through conduits into a journal in the center of the crankshaft 16 that carries the oil from the oil pump to the connecting rod and the front main seals of the engine. The connecting rod 22 is coupled through a balancing cam 24 to the crankshaft. A piston (not shown) is connected to an upper end of the connecting rod and passes through a cylinder located in the head 14. At the top of the head 14 there is a valve cover 26 which overlays the valve control mechanism which is typically a set of rocker arms connected to drive the intake and exhaust valves between their open and closed positions via push rods that are coupled to the crankshaft 16.

The valve control mechanism in the valve cover 26 is lubricated by oil splashed from the reservoir 18 by movement of the crankshaft and various gears located in the crankcase. This oil splashes upward through an oil galley or passageway 28 extending from the lower crankcase through the head 14. In addition, because the piston attached to the connecting rod 22 moves up and down in the cylinder, the pressure in the crankcase changes with movement of the cylinder so as to force the splashed oil upward through the oil galley into the valve cover area.

Figure 2:
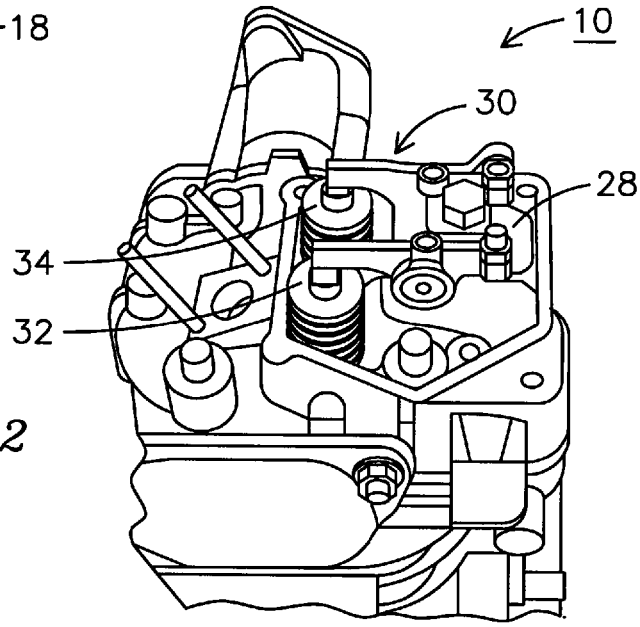
FIG. 2 is a top perspective view of an engine corresponding to FIG. 1.
Figure 3:
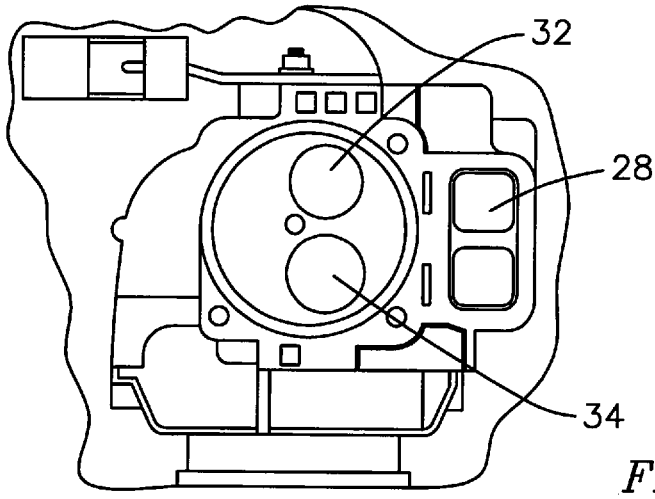
FIG. 3 is a top plan view of the engine of FIG. 2 with the rocker arm assembly removed.

FIG. 2 is a perspective view of the top of the engine 10 with the valve cover 26 removed so that the rocker arms or valve which shows the top of the engine 10 with the valve cover 26 removed so that the rocker arms or valve control mechanism 30 is visible. In FIG. 3, there is shown a top plan view of the engine 10 with the rocker arm assembly removed so that the exhaust valve and intake valve are clearly visible at 32 and 34 respectively. In addition, the oil galley 28 can be seen located to the side of the valves.

Considering now FIGS. 1, 2 and 3 together, it can be seen that when the engine is rotated so that the crankshaft 16 is oriented in a vertical configuration, the oil galley will become oriented in a horizontal configuration with the lower portion of the oil galley in this position overlapping the lower position of the exhaust valve 32. As a consequence, any oil collecting in the galley can flow freely into the exhaust and create both a smoke and emissions problem. In order to control the amount of oil that can be passed through the galley 28 into the valve mechanism, it is necessary to reduce the flow of oil through the galley and to provide a return path that allows oil below the level of the galley to drain back into the reservoir at 18.

Figure 4:
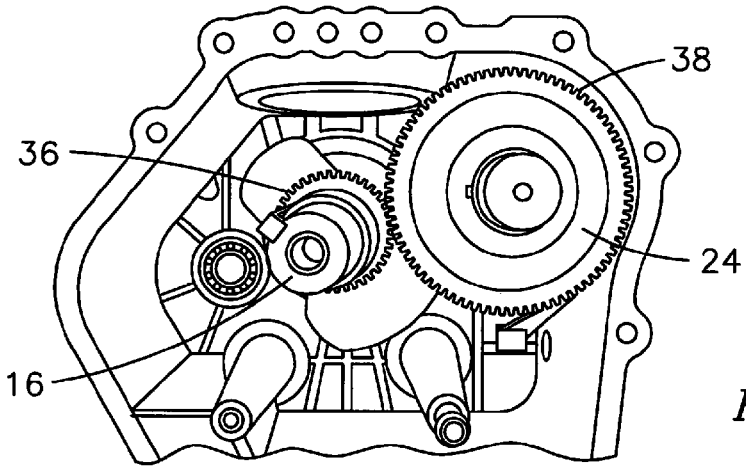
FIG. 4 is a view of the crankcase of the engine of FIG. 2 with one cover removed.
Figure 5:
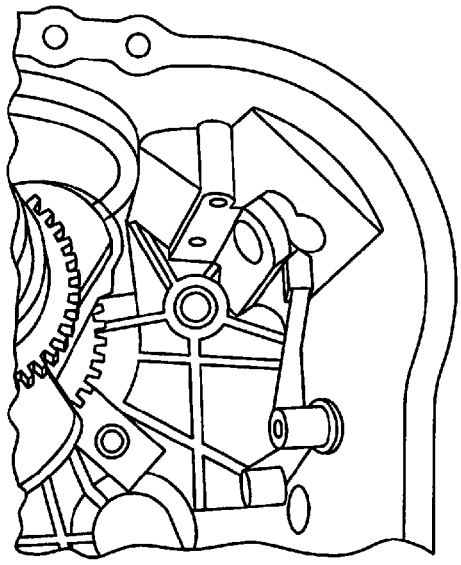
FIG. 5 is a view of the engine of FIG. 4 with the camshaft and drive gear removed.

Turning now to FIG. 4, there is shown a side view of the engine of FIG. 1 with part of the crankcase cover removed so that the driveshaft 16 and camshaft balancer 24 are now visible. In addition, the drive gear 36 on shaft 16 which drives the camshaft coupled to associated gear 38 is also visible. FIG. 5 is a portion of the image of FIG. 4 with the camshaft gear 38 removed so that the oil galley input can now be seen. In FIG. 5, the oil galley input is now blocked to prevent oil from being splashed into the galley and in addition the oil galley drain which is located at the bottom portion of the oil galley for returning oil is also blocked. This action essentially prevents the splashed oil from passing into the oil galley where it would accumulate around the exhaust valve. In addition, the engine is further modified by blocking the conventional oil pick-up used by the oil pump so that additional oil is not pumped into the oil galley. In one embodiment of the present invention, holes are drilled through the material used to block the oil galley input, either a plate or some form of an epoxy resin to block the input, so that oil can be allowed into the galley but at a controlled rate. The size of the holes drilled are determined by the size of the engine and the oil demand in the head of the engine to lubricate the rocker arm mechanism. This particular method is intended to raise the level of oil in the galley and reduce the amount of airborne oil to only the necessary amount needed for proper operation of the engine. In a more controlled application, pressurized oil may be introduced into the area of the rocker arm mechanism by connecting tubing between the oil conduit extending from the oil pump and the opening into the oil galley.

Figure 6:
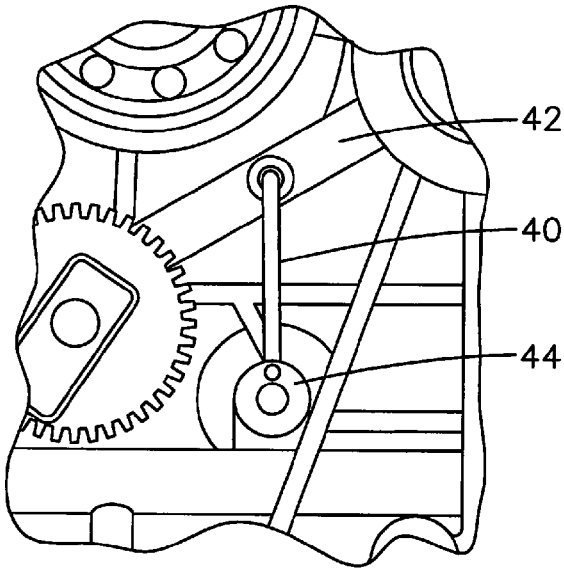
FIG. 6 shows a modification of the engine of FIG. 5 for pressure lubrication of the rocker arm mechanism.
Figure 7:
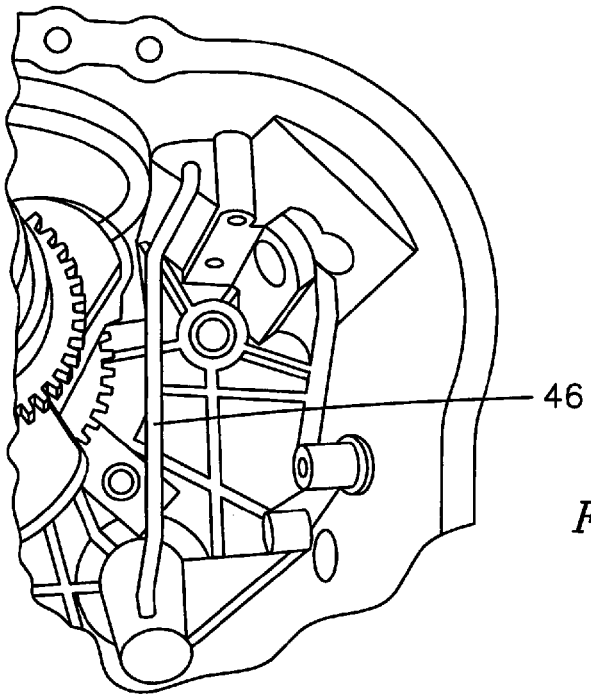
FIG. 7 shows a further modification of the engine of FIG. 6 to provide additional oil flow paths.
Figure 8:
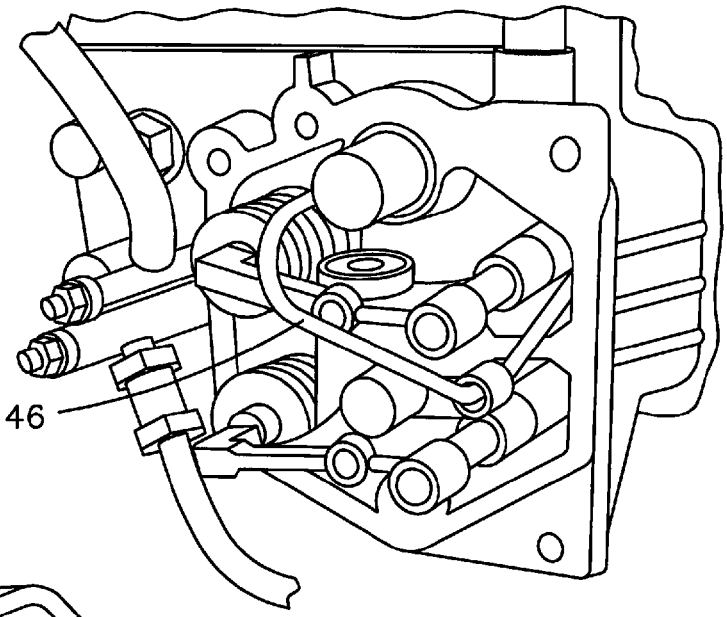
FIG. 8 shows the tubing of FIG. 7 routed to the rocker arms.

Turning now to FIG. 6, there is shown a modification of the engine in which a tube 40 is now coupled from the oil conduit 42 into a hole drilled into a mounting support 44 proximal to the oil pump. Another hole is also drilled into the support 44 for connection of a second tube. Considering FIG. 7, it can be seen that the second tube extends through the crankcase along the surface of the crankcase cover and is routed upward to the front of the engine along the supports to avoid the spinning crankshaft, camshaft and associated gears. The tube 46 is then routed upward through the plate blocking the galley and is passed through a seal that seals the galley from the crankcase of the engine. The tube exits the galley into the head and is positioned over the rocker arm apparatus so that a flow of oil is directed directly over the tops of the intake valve rocker arm, as shown in FIG. 8. This oil then drains downward into the lower sections of the valve cover. As the oil condenses and collects at the bottom of the valve cover, it can be drained by separate fitting attached through a hole in the lowest point of the valve cover and routed back to the reservoir at the bottom of the crankcase where it mixes with the other oil 18. Preferably, however, the oil from the crankcase passes through a filter prior to reentering the crankcase so as to remove any contaminants in the oil caused by lubrication at the top of the cylinder head. In one form, the oil draining from the rocker arm cover can be directed through one line and connector threaded into a separate fitting attached to the conventional oil filter at a low pressure side so that the oil filter processes both the main oil and the oil draining from the valve cover.

Figure 9:
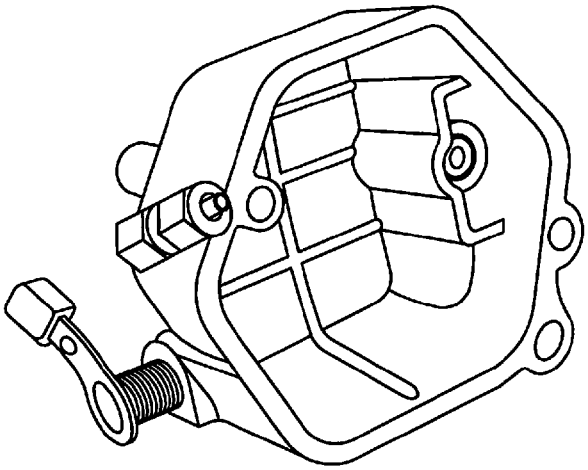
FIG. 9 shows drain tubing for the valve cover of the engine of FIG. 2.

It is also noted that the oil pickup and filter assembly is a screened tube within a tube and if the pickup port used in the horizontal oil intake of the engine is blocked, there would be no avenue for the crankcase oil to enter the pickup tube. Thus, it may be necessary to drill a small hole near the base of the pickup tube to accommodate pickup of oil. The inner diameter of this new pickup port is intentionally sized so that the negative pressure created by the oil pump favors the new tubing from the valve cover. The net result of this change is a small negative pressure inside the valve cover that insures oil drainage. In addition, a one way valve may be added to the valve cover filter line to eliminate the possibility of oil reversing course from the filter pickup area to the head, as shown in FIG. 9.

What has thus been described is a method for modifying a small diesel engine that is normally adapted for running in a horizontal shaft configuration so that the engine can be rotated on its side to create a vertical shaft diesel engine. This allows the engine to be used in applications requiring vertical shafts such as in direct drive lawn mowers.

While the invention has been described in what is presently considered to be a preferred embodiment, various modifications and improvements will become apparent to those skilled in the art. It is intended therefore that the invention not be limited to the specific disclosed embodiment but be interpreted within the full spirit and scope of the appended claims.

What is claimed is:

1. A method for converting a diesel engine from a horizontal shaft configuration to a vertical shaft configuration, the engine having at least one cylinder and a piston operational in the cylinder in a plane normal to an axis of the shaft, an intake valve and an exhaust valve positioned at a top of the cylinder and an oil reservoir located below the cylinder, the piston being connected in driving relationship to the shaft and a passageway extending from the area of the oil reservoir to an operating mechanism for the intake and exhaust valves whereby the mechanism is lubricated by splashing of oil from the oil reservoir through the passageway, the method comprising:

blocking the passageway from the oil reservoir to the mechanism;

providing a secondary controlled flow corridor to direct a spray of oil to the mechanism; and positioning the engine with the shaft oriented vertically.

2. The method of claim 1 wherein the secondary flow corridor couples a pressurized source of oil to the mechanism.

3. The method of claim 2 wherein the pressurized source comprises an oil pump.

4. The method of claim 1 wherein the step of blocking includes blocking the passageway and an oil return line.

5. The method of claim 1 wherein the passageway collects oil after lubrication of the mechanism.

* * * * *